United States Patent [19]

Lamboy

[11] Patent Number: 5,029,874

[45] Date of Patent: Jul. 9, 1991

[54] SHOOTING TARGET OF FOAMED POLYSTYRENE

[75] Inventor: Stephen R. Lamboy, Victor, N.Y.

[73] Assignee: Sight Right Co., Victor, N.Y.

[21] Appl. No.: 361,382

[22] Filed: Jun. 5, 1989

[51] Int. Cl.[5] ..... F41J 3/02

[52] U.S. Cl. ..... 273/408

[58] Field of Search ..... 273/408, 403, 404

[56] References Cited

U.S. PATENT DOCUMENTS

| | | | |
|---|---|---|---|
| 2,818,259 | 12/1957 | Arenson | 273/408 |
| 3,899,175 | 8/1975 | Loe | 273/403 X |
| 4,433,843 | 2/1984 | Bricco | 273/408 X |

*Primary Examiner*—Paul E. Shapiro

*Attorney, Agent, or Firm*—Eugene Stephens & Associates

[57] ABSTRACT

A foamed polystyrene shooting target (10) is made thinner and more dense with a thin skin (13) of solid polystyrene on its entry face (12) and with a printed image (11) for shooting at. The preferred thickness is from 0.050 to 0.080 inches, and the preferred density is from 3.0 to 4.0 pounds per cubic foot. The target then forms clean cut and full size holes for bullets passing through so that it serves as an accurate indicator of where the bullets hit. This indication is normally visible from where the bullets were fired.

11 Claims, 1 Drawing Sheet

SHOOTING TARGET OF FOAMED POLYSTYRENE

BACKGROUND

Shooting targets made of foamed polystyrene material have advantages over paper. Besides being sturdier and better able to support themselves, foamed polystyrene targets leave more visible holes where bullets pass through so that the places where bullets hit the target can be seen from a greater distance. The holes in paper targets tend to reclose after a bullet has passed through so that the shooter has to look at a paper target more closely to tell where the shots hit.

Previously sold targets of foamed polystyrene material have partially realized these advantages, but have experienced problems with partially reclosed holes smaller than the bullets that made them and cracking of the polystyrene material around the edges of bullet holes. I have investigated these problems and devised an improvement in foamed polystyrene targets that assures cleanly punched out holes of the same diameter as the bullets making them, without cracking the foamed polystyrene material around the holes. My improved targets are readable at a greater distance, are cleaner and more accurate in representing where the bullets hit, and are durable and versatile in accommodating different mounting systems and different sizes and types of bullets and shot. My improved targets also accomplish these advantages economically so that they can be made at a low cost.

SUMMARY OF THE INVENTION

My foamed polystyrene target is formed with a total thickness of foamed polystyrene material in the range of 0.050 to 0.080 inches. This is thinner than previous foamed polystyrene targets and assures that bullet holes are the same diameter as the bullets making them. The entry face of my target bears an image to shoot at, and the image is preferably printed, rather than being a paper bull's eye adhered to the foamed polystyrene material. Paper in a bull's eye or other image on the entry face of the target tends to reclose the hole made by a passing bullet. My target's entry face also preferably has a solid polystyrene skin made thicker and more brittle than the skin on previous foamed polystyrene targets. The solid skin thickness of my target is preferably in the range of 0.0015 to 0.0025 inches and is preferably in the middle of that range at about 0.0020 inches. The density of the foamed polystyrene material in my target is preferably 3.0 to 4.0 pounds per cubic foot, which is denser than previous foamed polystyrene targets. The greater density helps make the targets strong and durable and also helps the bullets make clean cut holes without cracking the target material around the hole. If cracks develop around bullet holes, the target material can break apart and lose its value as an indicator of where the shots hit.

DRAWINGS

DETAILED DESCRIPTION

Figure 1:
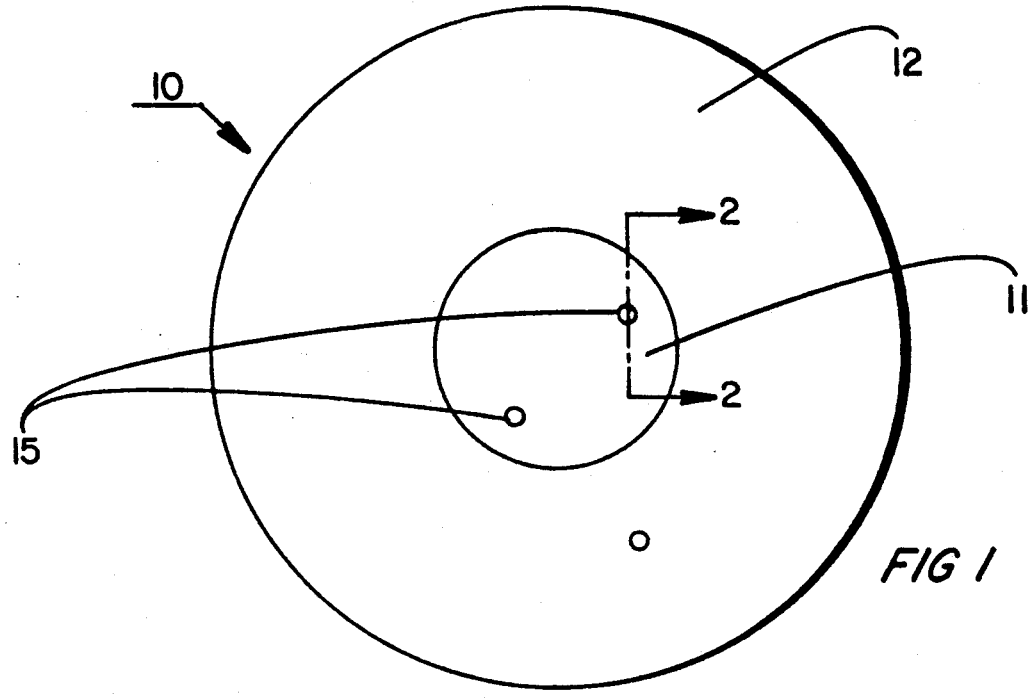
FIG. 1 is a front elevational view of a preferred embodiment of a foamed polystyrene target made according to my invention.
Figure 2:
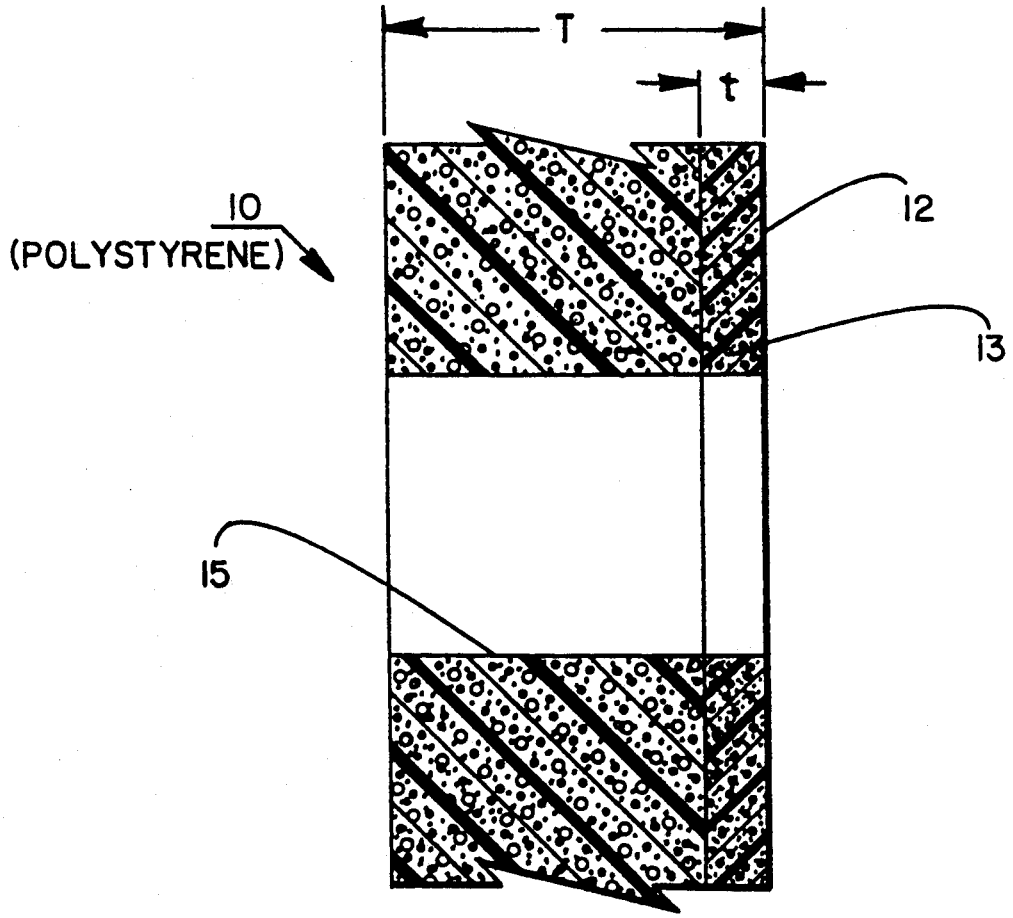
FIG. 2 is an enlarged, fragmentary cross-sectional view of the target of FIG. 1, taken along the line 2—2 thereof.

I prefer a circular form for target 10, as shown in FIG. 1, but many other forms are also possible. These can include squares, rectangles, and representations of a human figure, game animal, or object, depending on the purpose of the target practice. An image 11 on an entry face 12 of target 10 provides something to shoot at, and the most popular image for this is a circular bull's eye, a shown in FIG. 1. I prefer that target 10 be formed of a bright white, foamed polystyrene material, with a bull's eye 11 of blaze orange color. This forms a dazzling and highly visible image that is very suitable for shooting at. Different shaped images on different targets can also be represented in different colors, though.

The improvement made by my target 10 involves the material of which target 10 is made. This differs from previous foamed polystyrene target material in being thinner and denser with a thicker surface skin, preferably bearing a printed image. These changes cooperate to make target 10 more accurately represent the areas hit by bullets or shot.

Previous foamed polystyrene targets were made from packaging material manufactured for purposes such as meat trays and egg cartons, and they were 0.125 inches or more in thickness. While this allowed a bullet to make a readily visible hole as it passed through the foamed polystyrene material, my research has shown that the bullet hole in such material is partially reclosed and does not have the full diameter of the bullet that made it. My research also shows that thinner foamed polystyrene having a thickness T in the range of 0.050 to 0.080 inches and larger bullet holes. Since a target is used to represent where the bullets hit and to make that representation cleanly and accurately visible, it is most desirable for the bullet to make a clean and full sized hole as it passes through the target material. The bullet hole should appear to be die cut, with a cleanly punched edge and should not have a bent edge that is partially reclosed, which occurs with the thicker foamed polystyrene material previously used for targets. A few of the desired, clean cut bullet holes 15 are illustrated in target 10.

The material of target 10 is also denser than the material of previous foamed polystyrene targets. Foamed polystyrene material for packaging purposes typically has densities in a range of 1.5 to 2.75 pounds per cubic foot, but I have discovered that a denser foamed polystyrene material having a density in the range of 3.0 to 4.0 pounds per cubic foot works better as a target material. The greater density of material for target 10 contributes to target strength and helps prevent cracking of the target material around the edges of bullet holes. Cracking must be minimized to assure that the target material does not break apart, especially after being hit by many bullets. Once a target breaks, its record of bullet hits is impaired and harder to read.

The material of target 10 also has a thicker skin than was previously used. Solid polystyrene skins on the surfaces of packaging material typically range from 0.0003 to 0.0006. I have discovered that a thicker skin breaks cleaner and contributes to a clean cut bullet hole without increasing the risk of cracking, and the solid skin 13 on my foamed polystyrene target is preferably thicker with a thickness in a range of 0.0015 to 0.0025 inches. I prefer that skin in the middle of this range at 0.0020 inches, and I also prefer that the skin side of the target be formed on its entry face 12, bearing image 11 to shoot at. The solid skin 13 is preferably on only one side of target 10.

These improvements make target 10 readable from where the shoots were fired, in most circumstances. Bullet holes are clean cut, full size, and clearly visible, especially when target 10 is made of bright white material, as I prefer. Holes are formed cleanly in target 10 for a full range of bullet sizes from the smallest firearms up to shotgun slugs. Each shot in a shot pattern from a shotgun also makes a clean hole in target 10 so that target 10 is a good indicator of shot patterns. The material of target 10 is also sturdy and versatile so that it can be pinned up in many ways and is adequately wind resistant to serve well under many circumstances.

I claim:

1. A shooting target made of a foamed polystyrene material, said target comprising:

a. a total thickness of said foamed polystyrene material being in the range of 0.050 to 0.080 inches;

b. an entry face of said material bearing an image to shoot at;

c. said entry face of said material having a solid polystyrene skin with a thickness in the range of 0.0015 to 0.0025 inches; and d. the density of said material being 3.0 to 4.0 pounds per cubic foot.

2. In a shooting target made of a foamed polystyrene material an entry face of which bears an image to shoot at, the improvement comprising:

a. the thickness of said polystyrene material being in the range of 0.050 to 0.080 inches; and b. the density of said polystyrene material being 3.0 to 4.0 pounds per cubic foot.

3. The improvement of claim 2 wherein said image is printed on said entry face of said material.

4. The improvement of claim 2 wherein said entry face of said material has a solid polystyrene skin with a thickness of about 0.0020 inches.

5. A foamed polystyrene target bearing an image to shoot at and being formed of a foamed polystyrene material, said target comprising:

a. said polystyrene material having an overall thickness in the range of 0.050 to 0.080 inches;

b. an entry face of said polystyrene material having a solid polystyrene skin with a thickness in the range of 0.0015 to 0.0025 inches; and c. said overall thickness and said skin thickness of said polystyrene material cooperating so that:

(1) a hold made in said target by a bullet passing through said target has the same diameter as said bullet; and (2) said material does not crack around said hole made by said bullet.

6. The target of claim 5 wherein said image is printed on said entry face of said material.

7. The target of claim 5 wherein the density of said polystyrene is 3.0 to 4.0 pounds per cubic foot.

8. The target of claim 5 wherein said skin thickness if 0.0020 inches.

9. In a shooting target made of a foamed polystyrene material an entry face of which bears an image to shoot at, the improvement comprising:

a. the density of said polystyrene material being 3.0 to 4.0 pounds per cubic foot; and b. said entry face of said material having a solid polystyrene skin with a thickness in the range of 0.0015 to 0.0025 inches.

10. The improvement of claim 9 wherein said image is printed on said entry face of said material.

11. The improvement of claim 9 wherein said skin thickness is 0.0020 inches.

* * * * *